US008216756B2

(12) United States Patent
Jang et al.

(10) Patent No.: US 8,216,756 B2
(45) Date of Patent: Jul. 10, 2012

(54) POLYMERIZED TONER AND METHOD OF PRODUCING THE SAME

(75) Inventors: Wook Jang, Daejeon (KR); Chang Soon Lee, Daejeon (KR); Woo Cheul Jung, Ulsan (KR)

(73) Assignee: LG Chem, Ltd., Seoul (KR)

( * ) Notice: Subject to any disclaimer, the term of this patent is extended or adjusted under 35 U.S.C. 154(b) by 261 days.

(21) Appl. No.: 12/621,195

(22) Filed: Nov. 18, 2009

(65) Prior Publication Data

US 2010/0129749 A1 May 27, 2010

(30) Foreign Application Priority Data

Nov. 18, 2008 (KR) ..... 10-2008-0114584

(51) Int. Cl.
*G03G 9/00* (2006.01)

(52) U.S. Cl. ..... 430/108.8; 430/137.15

(58) Field of Classification Search ..... 430/108.8, 430/137.15

See application file for complete search history.

(56) References Cited

U.S. PATENT DOCUMENTS

| | | | | |
|---|---|---|---|---|
| 7,601,474 | B2 * | 10/2009 | Ogata et al. | 430/108.8 |
| 2001/0018158 | A1 * | 8/2001 | Yoshida et al. | 430/125 |
| 2003/0016955 | A1 * | 1/2003 | Hiratsuka et al. | 399/27 |

* cited by examiner

*Primary Examiner* — Mark A Chapman

(74) *Attorney, Agent, or Firm* — Rothwell, Figg, Ernst & Manbeck, P.C.

(57) ABSTRACT

A polymerized toner is provided. The polymerized toner has cores containing a wax with a polydispersity of 1.05 to 1.1. The fixability of the polymerized toner is improved by the presence of the wax. Further provided is a method of producing the polymerized toner.

13 Claims, No Drawings

POLYMERIZED TONER AND METHOD OF PRODUCING THE SAME

CROSS REFERENCE TO RELATED APPLICATIONS

This application claims priority from Korean patent application No. 10-2008-0114584 filed on Nov. 18, 2008, which is hereby incorporated herein by reference in its entirety for all purposes.

BACKGROUND OF THE INVENTION

1. Field of the Invention

The present invention relates to a polymerized toner and a method of producing the polymerized toner. More specifically, the present invention relates to a polymerized toner whose cores contain a wax having a narrow molecular weight distribution.

2. Description of the Related Art

Toners are used for the development of electrophotographic images and in electrostatic printers, copiers, etc. Toners refer to coating substances that can be transferred and fixed to substrates to form desired patterns on the substrates. As computer-aided documentation has been generalized in recent years, there has been a rapidly increasing demand for image forming apparatuses, such as printers. In response to this demand, the use of toners is also on the rise.

Methods for the production of toners are largely classified into two types, i.e. methods based on pulverization and polymerization. The first type of methods based on pulverization is most widely known. According to a typical toner production method based on pulverization, a resin and a pigment are melt-mixed or extruded, pulverized and classified to obtain toner particles. However, the toner particles have a broad particle diameter distribution and are very irregular in shape (e.g., sharp-edged), which are disadvantageous in terms of charging characteristics and flowability.

To overcome the above disadvantages of the first type of methods, the second type of methods for the production of spherical toner particles based on polymerization has been proposed. It is known that the second type of methods can be carried out by emulsion polymerization/aggregation and suspension polymerization. According to emulsion polymerization, the size distribution of particles is difficult to control and the reproducibility of toner quality remains problematic. For these reasons, suspension polymerization is employed in preference to emulsion polymerization.

Polymerized toner cores prepared by suspension polymerization have improved fixability due to the presence of a wax therein. In view of the recent trend toward high printing speed and low fixing temperatures in an effort to reduce energy consumption, the use of general waxes in polymerized toners makes it difficult to expect sufficiently improved fixability of the polymerized toners.

SUMMARY OF THE INVENTION

The present invention has been made in an effort to solve the above problems, and it is an object of the present invention to provide a polymerized toner whose cores contain an alkoxy-terminated wax having a polydispersity of 1.05 to 1.1, which means a narrow molecular weight distribution, to achieve improved fixability.

It is another object of the present invention to provide a method of producing the polymerized toner.

According to one aspect of the present invention, there is provided a polymerized toner whose cores contain a wax having a polydispersity of 1.05 to 1.1 and represented by Formula 1:

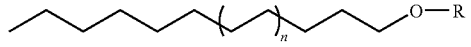

(1)

wherein R is a $C_1$-$C_3$ alkyl group and n is an integer from 24 to 180.

In an embodiment, the wax has a melting temperature ($T_m$) of 80 to 130° C.

In an embodiment, the wax has a viscosity at 150° C. of 1 to 130 cP.

In an embodiment, the polymerized toner is prepared by polymerization of a monomer mixture including the wax, one or more binder resin monomers and a charge control agent.

In an embodiment, the binder resin monomers are selected from the group consisting of a vinyl aromatic monomer, an acrylic monomer, a methacrylic monomer and a diene monomer.

In an embodiment, the binder resin monomers further include an acidic or basic olefin monomer.

In an embodiment, the charge control agent is a nigrosine type acidic dye, a higher aliphatic metal salt, an alkoxyamine, a chelate, a quaternary ammonium salt, an alkylamide, a fluorinated activator, a metal salt of naphthenic acid, an acidic organic complex, chlorinated paraffin, a chlorinated polyester, a polyester having acid groups, a sulfonylamine of copper phthalocyanine, a styrene-acrylic polymer having sulfonic acid groups or a mixture thereof.

In an embodiment, the monomer mixture further includes at least one additive selected from the group consisting of a crosslinking agent, a molecular weight modifier and a reaction initiator.

In an embodiment, the crosslinking agent is divinylbenzene, ethylene dimethacrylate, ethyleneglycol dimethacrylate, diethyleneglycol diacrylate, 1,6-hexamethylene diacrylate, allyl methacrylate, 1,1,1-trimethylolpropane triacrylate, triallylamine, tetraallyloxyethane or a mixture thereof.

In an embodiment, the molecular weight modifier is t-dodecyl mercaptan, n-dodecyl mercaptan, n-octyl mercaptan, carbon tetrachloride, carbon tetrabromide or a mixture thereof.

In an embodiment, the polymerized toner comprises 60 to 95 parts by weight of the binder resin monomers, 0.1 to 30 parts by weight of the wax, 0.001 to 10 parts by weight of the crosslinking agent, 0.1 to 20 parts by weight of the charge control agent, 0.001 to 8 parts by weight of the molecular weight modifier, and 0.01 to 5 parts by weight of the reaction initiator.

According to another aspect of the present invention, there is provided a method of producing a polymerized toner, comprising mixing a dispersion stabilizer with water to prepare an aqueous dispersion, homogenizing a monomer mixture including a wax, binder resin monomers and a charge control agent in the aqueous dispersion to disperse the monomer mixture in the form of fine droplets, polymerizing the homogenized monomer mixture to prepare polymerized toner cores, washing and drying the polymerized toner cores, and coating the polymerized toner cores with an external additive, wherein the wax has a polydispersity of 1.05 to 1.1 and is represented by Formula 1:

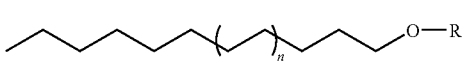

(1)

wherein R is a $C_1$-$C_3$ alkyl group and n is an integer from 24 to 180.

In an embodiment, the aqueous dispersion is prepared by mixing 1 to 10 parts by weight of the dispersion stabilizer with 100 parts by weight of the water.

In an embodiment, the dispersion stabilizer is a water-soluble polyvinyl alcohol (PVA) having a degree of polymerization of 1,500 to 2,500 and a degree of saponification of 75 to 98%.

DETAILED DESCRIPTION OF THE INVENTION

The present invention provides a polymerized toner that is produced by mixing a dispersion stabilizer with water to prepare an aqueous dispersion, mixing a monomer mixture including a wax having a narrow molecular weight distribution with the aqueous dispersion to homogenize the monomer mixture, polymerizing the homogenized monomer mixture to prepare polymerized toner cores, and washing and drying the polymerized toner cores.

Exemplary embodiments of the present invention will now be described in detail.

The monomer mixture includes a wax, binder resin monomers and a charge control agent. The monomer mixture further includes at least one additive selected from the group consisting of a crosslinking agent, a molecular weight modifier and a reaction initiator.

As the binder resin monomers, there can be used one or more monomers selected from the group consisting of a vinyl aromatic monomer, an acrylic monomer, a methacrylic monomer and a diene monomer. Optionally, the binder resin monomers may further include an acidic or basic olefin monomer.

The vinyl aromatic monomer is selected from the group consisting of styrene, monochlorostyrene, methylstyrene, and dimethylstyrene. It is preferred to use the vinyl aromatic monomer in an amount of 30 to 90 parts by weight, based on 100 parts by weight of all the binder resin monomers.

The acrylic monomer is selected from the group consisting of methyl acrylate, ethyl acrylate, n-butyl acrylate, isobutyl acrylate, dodecyl acrylate and 2-ethylhexyl acrylate. The methacrylic monomer is selected from the group consisting of methyl methacrylate, ethyl methacrylate, n-butyl methacrylate, isobutyl methacrylate, dodecyl methacrylate and 2-ethylhexyl methacrylate. The diene monomer is selected from the group consisting of butadiene and isoprene.

At least one monomer selected from the acrylic monomer, the methacrylic monomer and the diene monomer is preferably used in an amount of 5 to 70 parts by weight, based on 100 parts by weight of all the binder resin monomers.

The acidic olefin monomer may be an α,β-ethylenically unsaturated compound having at least one carboxyl group. The basic olefin monomer may be a methacrylic acid ester, methacrylamide, vinylamine or diallyl amine of an aliphatic alcohol having at least one amine group or quaternary ammonium group, or an ammonium salt thereof. The acidic and/or basic olefin monomer is preferably used in an amount of 0.1 to 30 parts by weight, based on 100 parts by weight of all the binder resin monomers.

0.01 to 10 parts by weight of at least one polar polymer selected from polyesters and styrene-acrylic polymers may be added to 100 parts by weight of the binder resin monomers.

As the charge control agent, there can be used: a cationic charge control agent, such as a nigrosine type acidic dye, a higher aliphatic metal salt, an alkoxyamine, a chelate, a quaternary ammonium salt, an alkylamide, a fluorinated activator or a metal salt of naphthenic acid; an anionic charge control agent, such as an acidic organic complex, chlorinated paraffin, a chlorinated polyester, a polyester containing an excess of acid groups, a sulfonylamine of copper phthalocyanine or a styrene-acrylic polymer having sulfonic acid groups; or a mixture thereof. It is preferred to use the charge control agent in an amount of 0.1 to 20 parts by weight, based on 100 parts by weight of the monomer mixture.

The polymerized toner of the present invention is characterized by the use of the wax having a narrow molecular weight distribution to achieve improved fixability. The wax has a polydispersity ranging from 1 to 1.15 and more preferably from 1.05 to 1.1.

The polydispersity ($M_w/M_n$) is the ratio of weight average molecular weight ($M_w$) to number average molecular weight ($M_n$). The wax used in the polymerized toner is sufficiently melted in the temperature range of a fixing roll during printing to improve the fixability of the toner. The wax having a polydispersity lower than 1 is, in practice, difficult to prepare, and the wax having a polydispersity higher than 1.15 remains unmelted on a fixing roll after printing, causing poor fixability of the toner during subsequent printing.

The wax has a melting temperature ($T_m$) of 80 to 130° C. Since the wax having a $T_m$ lower than 80° C. has low viscosity and high surface energy, fine droplets may be formed during homogenization, leading to the formation of a fine toner powder. A $T_m$ higher than 130° C. leads to poor fixability of the wax.

The wax has a viscosity at 150° C. of 1 to 130 cP. The use of the wax having a viscosity lower than 1 cP increases the possibility that a fine toner powder may be formed. Meanwhile, the use of the wax having a viscosity higher than 130 cP deteriorates the fixability of the toner.

The wax may be a compound represented by Formula 1:

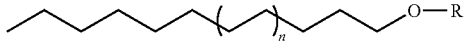

(1)

wherein R is a $C_1$-$C_3$ alkyl group and n is an integer from 24 to 180.

The wax is terminated with an alkoxy group. Since the alkoxy-terminated wax is highly compatible with the monomers, it can be effectively melted together with the polymerized monomers on a fixing roll in comparison with an unalkoxylated wax.

The wax is used in an amount of 0.1 to 30 parts by weight, based on 100 parts by weight of the monomer mixture. The use of the wax in an amount of less than 0.1 parts by weight does not ensure sufficient releasability of the toner, causing the toner to be melt-attached to a fixing roll during printing. Meanwhile, the use of the wax in an amount of more than 30 parts by weight may deteriorate the polymerization stability of the monomer mixture.

Particulate silica is used as an external additive.

The silica is used in an amount of 1 to 5 parts by weight, based on 100 parts by weight of the polymerized toner cores.

The external additive is coated on the surface of the polymerized toner cores with stirring at a high speed.

The monomer mixture may further include at least one additive selected from the group consisting of a crosslinking agent, a molecular weight modifier and a reaction initiator.

The crosslinking agent may be divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine or tetraallyloxyethane. It is preferred to use the crosslinking agent in an amount of 0.001 to 10 parts by weight, based on 100 parts by weight of the monomer mixture.

The molecular weight modifier may be selected from the group consisting of t-dodecyl mercaptan, n-dodecyl mercaptan, n-octyl mercaptan, carbon tetrachloride, carbon tetrabromide and mixtures thereof. It is preferred to use the molecular weight modifier in an amount of 0.001 to 8.000 parts by weight, based on 100 parts by weight of the binder resin monomers.

The reaction initiator may be an oil-soluble or water-soluble initiator. Specific examples of the reaction initiator include: azo initiators, such as azobisisobutyronitrile and azobisvaleronitrile; organic peroxides, such as benzoyl peroxide and lauroyl peroxide; and generally used water-soluble initiators, such as potassium persulfate and ammonium persulfate. The reaction initiator is preferably used in an amount of 0.01 to 5.00 parts by weight and more preferably 0.1 to 2.0 parts by weight, based on 100 parts by weight of the binder resin monomers.

A polyvinyl alcohol (PVA) is preferred as the dispersion stabilizer. The polyvinyl alcohol is dispersed in water to prepare an aqueous dispersion.

The polyvinyl alcohol (PVA) has a degree of polymerization of 1,500 to 2,500 and preferably 1,700 to 2,100. The polyvinyl alcohol (PVA) has a degree of saponification of 75 to 98% and preferably 85 to 95%. If the polyvinyl alcohol (PVA) has a degree of polymerization lower than 1,500, it is difficult to sufficiently disperse the monomer mixture in the aqueous dispersion. Meanwhile, if the polyvinyl alcohol (PVA) has a degree of polymerization exceeding 2,500, it is difficult to make the aqueous dispersion uniform due to the low water solubility of the polyvinyl alcohol. The polyvinyl alcohol (PVA) having a degree of saponification of less than 75% tends to precipitate in the water due to its low solubility when the reaction temperature is increased to 60 to 90° C. This precipitation makes it impossible to appropriately disperse the monomer mixture in the aqueous dispersion. Meanwhile, the polyvinyl alcohol (PVA) having a degree of saponification exceeding 98% is disadvantageous as a dispersant in terms of performance due to its high hydrophilicity. The dispersion stabilizer is present in an amount of 1 to 10 parts by weight, based on 100 parts by weight of the aqueous dispersion.

The present invention also provides a method of producing a polymerized toner.

Specifically, the method of the present invention comprises mixing a dispersion stabilizer with water to prepare an aqueous dispersion, homogenizing a monomer mixture including a wax, binder resin monomers and a charge control agent in the aqueous dispersion to disperse the monomer mixture in the form of fine droplets, polymerizing the homogenized monomer mixture to prepare polymerized toner cores, washing and drying the polymerized toner cores, and coating the polymerized toner cores with an external additive, wherein the wax has a polydispersity of 1.05 to 1.1.

Hereinafter, the individual steps of the method according to the present invention will be explained in detail.

(1) Preparation of Polymerized Toner Cores

First, a water-soluble polyvinyl alcohol (PVA) as a dispersion stabilizer is dispersed in water to prepare an aqueous dispersion. A monomer mixture including a wax is homogenized in the aqueous dispersion while applying a shear force using a homogenizer, followed by polymerization to prepare toner cores.

The monomer mixture includes one or more binder resin monomers selected from the group consisting of a vinyl aromatic monomer, an acrylic monomer, a methacrylic monomer and a diene monomer. Optionally, the binder resin monomers may further include an acidic or basic olefin monomer. If necessary, the binder resin monomers may further include at least one additive selected from the group consisting of a crosslinking agent, a molecular weight modifier and a reaction initiator.

(2) Removal of the Dispersion Stabilizer (Polyvinyl Alcohol (PVA)) and Drying

In this step, the polyvinyl alcohol (PVA) is separated from the solution containing the polymerized toner cores by a suitable method. First, the aqueous dispersion containing the polyvinyl alcohol (PVA) and the polymerized toner cores is diluted with a two-fold amount of distilled water. A homogenizer is used to apply a shear force to the dilute aqueous solution, followed by separation and cleaning using a suitable apparatus, such as a filter, a filter press, a general centrifuge or a continuous decanter type high-speed centrifuge, to separate the polyvinyl alcohol from the toner cores. Then, filtration is conducted to remove moisture, leaving the toner cores in the form of a cake. The cake is put into an oven and is dried under vacuum at room temperature.

(3) Coating with External Additive

Silica as an external additive is added to the polymerized toner cores, and the resulting mixture is stirred using a Henschel mixer at a high speed of 5,000 rpm for 7 min to coat the external additive on the surface of the polymerized toner cores.

Hereinafter, the present invention will be explained in more detail with reference to the following examples. However, these examples serve to provide further appreciation and disclosure of the invention but are not meant in any way to restrict the scope of the invention.

EXAMPLES

Example 1

(Preparation of Polymerized Toner Cores)

5 Parts by weight of a water-soluble polyvinyl alcohol (degree of polymerization=1,700, degree of saponification=90%) as a dispersion stabilizer was added to 400 parts by weight of ion-exchange water. After the mixture was stirred at room temperature for 10 min, the temperature was raised to 70° C., which is a reaction temperature in the subsequent step. The mixture was further stirred for 20 min to give an aqueous dispersion.

160 Parts by weight of styrene, 36 parts by weight of n-butyl acrylate and 4 parts by weight of acrylic acid as monomers, 4 parts by weight of allyl methacrylate as a crosslinking agent and 0.4 parts by weight of n-dodecyl mercaptan as a molecular weight modifier were mixed together. One part by weight of a styrene-acrylic polymer having sulfonic acid groups as a charge control agent was sufficiently dissolved in the mixture and 10 parts by weight of a pigment was added thereto. After the resulting mixture was stirred in a bead mill at 2,000 rpm for 2 hr, the beads were removed to obtain 225 parts by weight of the mixture of the monomers and the pigment.

The mixture thus obtained was heated to 70° C. in a water bath. Then, 5 parts by weight of the wax of Formula 1 (n=40, R=$CH_3$), which has a $T_m$ is 100° C., a viscosity at 150° C. of 7 cP and a polydispersity of 1.07, was added, followed by stirring 20 min to prepare a monomer mixture. The monomer mixture was homogenized in the aqueous dispersion using a homogenizer at a speed of 13,000 rpm to disperse the monomer mixture in the form of fine droplets. Thereafter, the monomer mixture was allowed to react with stirring using a paddle stirrer at 200 rpm for 15 min to prepare polymerized toner cores.

(Centrifugal Cleaning)

The aqueous dispersion containing the polymerized toner cores was diluted with a two-fold amount of distilled water. A shear force was applied to the dilute aqueous solution using a homogenizer, followed by centrifugation in a centrifuge (Beckman J2-21M, Rotor JA-14) at 3,000 rpm for 15 min to obtain a concentrate containing the polymerized toner cores. The concentrate was again diluted with a two-fold amount of distilled water. A shear force was applied to the dilute aqueous solution using a homogenizer, followed by centrifugation in a centrifuge (Beckman J2-21M, Rotor JA-14) at 3,000 rpm for 15 min. The above centrifugation procedure was further repeated twice to remove the polyvinyl alcohol (PVA) from the surface of the toner cores. Filtration was conducted to remove moisture, leaving a cake of the toner cores. The cake was put into an oven and was dried under vacuum at room temperature for 48 hr. The polymerized toner cores were measured to have a volume average particle diameter of 7 μm and a ratio of volume average particle diameter to number average particle diameter of 1.26.

(Coating with External Additive)

2 Parts by weight of silica as an external additive was added to 100 parts by weight of the polymerized toner cores. The mixture was stirred using a Henschel mixer at a high speed of 5,000 rpm for 7 min to coat the external additive on the surface of the polymerized toner cores.

Example 2

A polymerized toner was produced in the same manner as in Example 1, except that the wax of Formula 1 (n=24, R=$CH_3$), which has a $T_m$ of 81° C., a viscosity at 150° C. of 2 cP and a polydispersity of 1.05, was used. The measurement results of the polymerized toner are shown in Table 1.

Example 3

A polymerized toner was produced in the same manner as in Example 1, except that the wax of Formula 1 (n=50, R=$CH_3$), which has a $T_m$ of 107° C., a viscosity at 150° C. of 10 cP and a polydispersity of 1.07 was used. The measurement results of the polymerized toner are shown in Table 1.

Example 4

A polymerized toner was produced in the same manner as in Example 1, except that the wax of Formula 1 (n=120, R=$CH_3$), which has a $T_m$ of 126° C., a viscosity at 150° C. of 55 cP and a polydispersity of 1.08, was used. The measurement results of the polymerized toner are shown in Table 1.

Comparative Example 1

A polymerized toner was produced in the same manner as in Example 1, except that a wax having no terminal OR group in Formula 1 was used. The measurement results of the polymerized toner are shown in Table 1.

Comparative Example 2

A polymerized toner was produced in the same manner as in Example 1, except that the wax of Formula 1 (n=200), which has a $T_m$ of 140° C., a viscosity at 150° C. of 170 cP and a polydispersity of 1.07, was used. The measurement results of the polymerized toner are shown in Table 1.

Comparative Example 3

A polymerized toner was produced in the same manner as in Example 1, except that the wax of Formula 1 (n=20), which has a $T_m$ of 70° C., a viscosity at 150° C. of 0.5 cP and a polydispersity of 1.05, was used. The measurement results of the polymerized toner are shown in Table 1.

Comparative Example 4

A polymerized toner was produced in the same manner as in Example 1, except that the wax of Formula 1 having a polydispersity of 1.2 was used. The measurement results of the polymerized toner are shown in Table 1.

Experimental Example 1

Fixability Test

Each of the polymerized toners was printed on the front side of paper (A4 size). Unprinted paper (A4 size) was laid on the front side of the printed paper and rubbed while firmly pressing down with fingers. The fixability of the polymerized toner was evaluated by observing whether or not the toner was left on the unprinted paper.

TABLE 1

| | Wax of Formula 1 | | | | | |
|---|---|---|---|---|---|---|
| | $T_m$ (° C.) | n | Viscosity (cP) at 150° C. | Polydispersity | Presence or absence of terminal OR group | Fixability |
| Example 1 | 100 | 40 | 7 | 1.07 | ○ | Good |
| Example 2 | 81 | 24 | 2 | 1.05 | ○ | Good |
| Example 3 | 107 | 50 | 10 | 1.07 | ○ | Good |
| Example 4 | 126 | 120 | 55 | 1.08 | ○ | Good |
| Comparative Example 1 | 100 | 40 | 7 | 1.07 | X | Poor |
| Comparative Example 2 | 140 | 200 | 170 | 1.07 | ○ | Poor |
| Comparative Example 3 | 70 | 20 | 0.5 | 1.05 | ○ | Poor |
| Comparative Example 4 | 100 | 40 | 7 | 1.2 | ○ | Poor |

As can be seen from the results in Table 1, the polymerized toners of Examples 1-4, each of which comprises the wax of Formula 1 whose polydispersity, $T_m$ and viscosity are within the respective ranges defined above, showed improved fixability.

As is apparent from the foregoing, the fixability of the polymerized toner is improved by the use of the alkoxylated wax having a narrow molecular weight distribution.

What is claimed is:

1. A polymerized toner whose core contains a wax having a polydispersity of 1.05 to 1.1 and a viscosity at 150° C. of 1 to 130 cP, and represented by Formula 1:

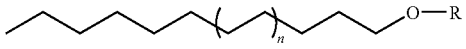

(1)

wherein R is a $C_1$-$C_3$ alkyl group and n is an integer from 24 to 180.

2. The polymerized toner of claim 1, wherein the wax has a melting temperature ($T_m$) of 80 to 130° C.

3. The polymerized toner of claim 1, wherein the polymerized toner is prepared by polymerization of a monomer mixture including the wax, at least one binder resin monomer and a charge control agent.

4. The polymerized toner of claim 3, wherein the binder resin monomer is selected from the group consisting of a vinyl aromatic monomer, an acrylic monomer, a methacrylic monomer and a diene monomer.

5. The polymerized toner of claim 4, wherein the binder resin monomer further includes an acidic or basic olefin monomer.

6. The polymerized toner of claim 3, wherein the charge control agent is a nigrosine type acidic dye, a higher aliphatic metal salt, an alkoxyamine, a chelate, a quaternary ammonium salt, an alkylamide, a fluorinated activator, a metal salt of naphthenic acid, an acidic organic complex, chlorinated paraffin, a chlorinated polyester, a polyester having acid groups, a sulfonylamine of copper phthalocyanine, a styrene-acrylic polymer having sulfonic acid groups or a mixture thereof.

7. The polymerized toner of claim 3, wherein the monomer mixture further comprises at least one additive selected from the group consisting of a crosslinking agent, a molecular weight modifier and a reaction initiator.

8. The polymerized toner of claim 7, wherein the crosslinking agent is divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine, tetraallyloxyethane or a mixture thereof.

9. The polymerized toner of claim 7, wherein the molecular weight modifier is t-dodecyl mercaptan, n-dodecyl mercaptan, n-octyl mercaptan, carbon tetrachloride, carbon tetrabromide or a mixture thereof.

10. The polymerized toner of claim 7, wherein the polymerized toner comprises 60 to 95 parts by weight of the binder resin monomer, 0.1 to 30 parts by weight of the wax, 0.001 to 10 parts by weight of the crosslinking agent, 0.1 to 20 parts by weight of the charge control agent, 0.001 to 8 parts by weight of the molecular weight modifier, and 0.01 to 5 parts by weight of the reaction initiator.

11. A method of producing a polymerized toner, the method comprising:

mixing a dispersion stabilizer with water to prepare an aqueous dispersion;

homogenizing a monomer mixture including a wax, a binder resin monomer and a charge control agent in the aqueous dispersion to disperse the monomer mixture in the form of fine droplets;

polymerizing the homogenized monomer mixture to prepare a polymerized toner core;

washing and drying the polymerized toner core; and coating the polymerized toner core with an external additive, wherein the wax has a polydispersity of 1.05 to 1.1 and a viscosity at 150° C. of 1 to 130 cP, and is represented by Formula 1:

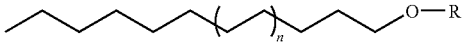

(1)

wherein R is a $C_1$-$C_3$ alkyl group and n is an integer from 24 to 180.

12. The method of claim 11, wherein the aqueous dispersion is prepared by mixing 1 to 10 parts by weight of the dispersion stabilizer with 100 parts by weight of the water.

13. The method of claim 11, wherein the dispersion stabilizer is a water-soluble polyvinyl alcohol (PVA) having a degree of polymerization of 1,500 to 2,500 and a degree of saponification of 75 to 98%.

* * * * *